US005832752A

United States Patent [19]

Zeller

[11] Patent Number: 5,832,752

[45] Date of Patent: Nov. 10, 1998

[54] PORTABLE CABLE LOCK

[76] Inventor: Noel E. Zeller, c/o Zelco Industries, Inc. 630 S. Columbus Ave., Mount Vernon, N.Y. 10551-4445

[21] Appl. No.: 848,859

[22] Filed: May 1, 1997

[51] Int. Cl.[6] ..... E05B 37/06

[52] U.S. Cl. ..... 70/30; 70/233; 70/52; 362/253; 242/373; 242/379

[58] Field of Search ..... 70/30, 233, 454, 70/446, DIG. 51, 432, 441, 443, 331, 18, 52, 58; 242/373, 379; 362/253

[56] References Cited

U.S. PATENT DOCUMENTS

| | | | |
|---|---|---|---|
| D. 296,659 | 7/1988 | Sakai | D8/331 |
| 314,985 | 3/1885 | Young . | |
| 574,179 | 12/1896 | Swenson | 70/30 |
| 2,574,967 | 11/1951 | Gossner . | |
| 2,647,960 | 8/1953 | Benjamin | 242/379 X |
| 2,933,915 | 4/1960 | Gossner . | |
| 3,611,760 | 10/1971 | Muther . | |
| 3,670,535 | 6/1972 | Stettner et al. | 70/30 X |
| 3,906,758 | 9/1975 | Hurwitt | 70/30 |
| 3,960,758 | 6/1976 | Hurwitt | 70/30 |
| 3,981,166 | 9/1976 | Madonna | 70/234 |
| 4,044,577 | 8/1977 | Horlacher | 70/234 |
| 4,086,795 | 5/1978 | Foster et al. | 70/233 |
| 4,098,099 | 7/1978 | Smith | 70/18 |
| 4,543,806 | 10/1985 | Papandrea et al. | 70/30 |
| 4,546,345 | 10/1985 | Naito | 340/542 |
| 4,663,611 | 5/1987 | Humphrey | 340/542 |
| 4,665,724 | 5/1987 | Sakai | 70/30 |
| 4,683,741 | 8/1987 | Fields | 70/432 |
| 4,691,539 | 9/1987 | Gover | 70/18 |
| 4,756,171 | 7/1988 | Homar | 70/30 X |
| 4,766,419 | 8/1988 | Hayward | 340/545 |
| 4,776,188 | 10/1988 | Dalaba et al. | 70/49 |
| 4,803,856 | 2/1989 | Ling | 70/52 X |
| 4,896,517 | 1/1990 | Ling | 70/18 |
| 4,959,981 | 10/1990 | Davidson | 70/238 |
| 4,970,882 | 11/1990 | Arrendondo | 70/30 |
| 5,023,596 | 6/1991 | Sirman et al. | 70/233 X |
| 5,111,007 | 5/1992 | Miller et al. | 200/43.08 |
| 5,156,028 | 10/1992 | Jiang | 70/30 |
| 5,251,464 | 10/1993 | Halfer | 70/30 |
| 5,367,785 | 11/1994 | Benarroch | 33/767 |
| 5,372,019 | 12/1994 | Hsiao | 70/38 A |
| 5,408,212 | 4/1995 | Meyers et al. | 340/427 |
| 5,560,232 | 10/1996 | Chen | 70/30 |
| 5,598,727 | 2/1997 | White | 70/233 |
| 5,715,709 | 2/1998 | Lai | 70/52 X |

FOREIGN PATENT DOCUMENTS

| | | | |
|---|---|---|---|
| 140534 | 4/1903 | Germany | 70/30 |
| 1933381 | 1/1971 | Germany | 70/30 |
| 3410047 | 10/1985 | Germany | 70/312 |
| 549893 | 10/1956 | Italy | 70/454 |

*Primary Examiner*—Suzanne Dino Barrett
*Attorney, Agent, or Firm*—Donald S. Dowden; Cooper & Dunham LLP

[57] ABSTRACT

A portable lock has a housing, a locking member connected to the housing, and a lock control mounted on the housing for selectively locking and unlocking the locking member. The housing is formed with a base and a tip, first and second sidewalls each extending from the base to the tip, and front and back walls each extending between the base, tip, and first and second sidewalls. The base is wider than the tip and the first and second sidewalls are farther apart from each other near the base than near the tip. When the housing is grasped by a hand having any orientation relative to the housing, the lock control is reachable for manipulation by at least one digit of the same hand. A light is mounted on the housing, and a wheel is mounted within the housing and has a hollow portion defining a compartment. A cable is trained around the wheel and has a proximal end secured within the housing and a distal end adapted to be withdrawn from the housing, wrapped around one or more objects to be secured, and inserted into the housing in locked relationship. A battery is accommodated within the compartment and connected to the light for powering the light.

4 Claims, 5 Drawing Sheets

PORTABLE CABLE LOCK

BACKGROUND OF THE INVENTION

1. Field of the Invention

This invention relates to locks and more particularly to a novel and highly effective portable cable lock of ergonomic design, light weight and compact construction and to a lock that is especially adapted to secure luggage and similar articles of travelers.

2. Description of the Related Art

Portable locks of many designs are known, including portable cable locks. As compared to a conventional padlock, a cable lock is versatile, since the locking member (the cable) is flexible and can secure objects having a variety of shapes. Also, the cable can have a substantial length for securing large objects, but not all of the length need be employed in every instance, and the unneeded part can be stored neatly in the lock housing.

Prior cable locks, however, leave much to be desired, especially when used under the difficult circumstances frequently encountered by travelers. Often air travelers need quick access to passports, tickets, money, cameras, medication, toiletries, and other items that may be stored in carry-on luggage or to clothing, gifts, souvenirs and other items that may be stored in checked luggage. Especially if one has several pieces of luggage, it may be awkward to operate a lock securing them all. Since it normally requires the use of both hands to operate a portable lock—one to steady the lock and the other to work the combination or key—, it may be necessary to set the luggage down in order to operate the lock.

Operation of a combination lock can possibly be accomplished using only one hand, but such combination locks are typically designed without regard for the construction of the hand, making one-handed operation difficult.

As compared to portable key locks, portable combination locks have the advantage that there is no key to lose and they are easier to operate using one hand. However, combination locks can be difficult to operate under the poor lighting conditions that travelers frequently encounter.

Another problem with conventional portable locks, especially cable locks having a light, is that they are insufficiently compact. If the cable is stored neatly in a housing when the lock is not in use, either the housing must be as long as the cable, or the cable must be coiled or wound within the housing. To minimize the maximum dimensions of the housing, the cable is commonly trained around a pulley or wheel mounted within the housing. The pulley must, however, have a certain minimum diameter in view of the length of the cable and limits on the flexibility of the cable. A battery for powering the light must also be of a certain size in order to store enough energy for service of a satisfactory duration in normal use. The pulley and battery plus other items often accommodated within the housing of a portable lock (springs, pawls, ratchets, etc.) require a housing that is larger than a typical traveler may be willing to carry. Obviously, a portable lock that is left at home because of its untoward bulk or weight affords a traveler no protection for his belongings.

OBJECTS AND SUMMARY OF THE INVENTION

An object of the invention is to remedy the problems of the prior art noted above and in particular to provide an ergonomic, portable lock that is designed with regard to the structure of the hand, that can be operated conveniently with one hand and under poor ambient light, and that is compact and weighs little. Another object of the invention is to provide a portable cable lock especially adapted to the needs of travelers.

The foregoing and other objects of the invention are attained in accordance with a first aspect thereof by providing an ergonomic, portable lock comprising a housing, a locking member connected to the housing, and a lock control mounted on the housing for selectively locking and unlocking the locking member. The housing is formed with a base and a tip, first and second sidewalls each extending from the base to the tip, and front and back walls each extending between the base, tip, and the first and second sidewalls. The base is wider than the tip and the first and second sidewalls are farther apart from each other near the base than near the tip. The housing is constructed so that, when grasped by a hand having any orientation relative to the housing, at least one digit of the same hand can reach the lock control.

Preferably, the locking member comprises a cable connected to the housing. Moreover, a pulley or wheel is mounted within the housing, a spring is mounted within the housing, and a flexible cable has a proximal portion wound around the wheel and attached to the spring. A distal portion of the cable can be withdrawn from the housing through a first opening in the housing, wrapped around or through one or more objects to be secured, and inserted into the housing through a second opening in locked relation thereto. The spring exerts a force opposing withdrawing the distal portion from the housing and tending to wind the cable on the wheel.

In a preferred embodiment of the invention, the lock control is a combination lock. Moreover, a light can be mounted on the housing for illuminating the lock control. One of the first and second cable openings in the housing is formed in the tip of the housing and the other in one of the first and second sidewalls of the housing.

In accordance with an independent aspect of the invention, the objects of the invention are attained by providing a portable lock comprising a housing, a light mounted on the housing, and a wheel mounted within the housing and having a hollow portion defining a compartment. A cable is trained around the wheel. The cable has a proximal portion accommodated within the housing and a distal portion adapted to be withdrawn from the housing, wrapped around one or more objects to be secured, and inserted into the housing in locked relationship. A battery is mounted within the compartment and connected to the light for powering the light. Preferably, the compartment and the battery are both circular, and the battery substantially fills the compartment. This combination of features contributes greatly to reducing what would otherwise be the required size of the lock in order to accommodate both a battery adequate to power the light for a substantial period of use and a wheel or pulley large enough to accommodate the flexible cable without putting too sharp a bend in it.

BRIEF DESCRIPTION OF THE DRAWINGS

A better understanding of the objects, features and advantages of the invention can be gained from the following detailed description of the preferred embodiment thereof, wherein a given reference character always refers to the same element or part, and wherein.

DESCRIPTION OF THE PREFERRED EMBODIMENTS

Figures 1, 2, 3:
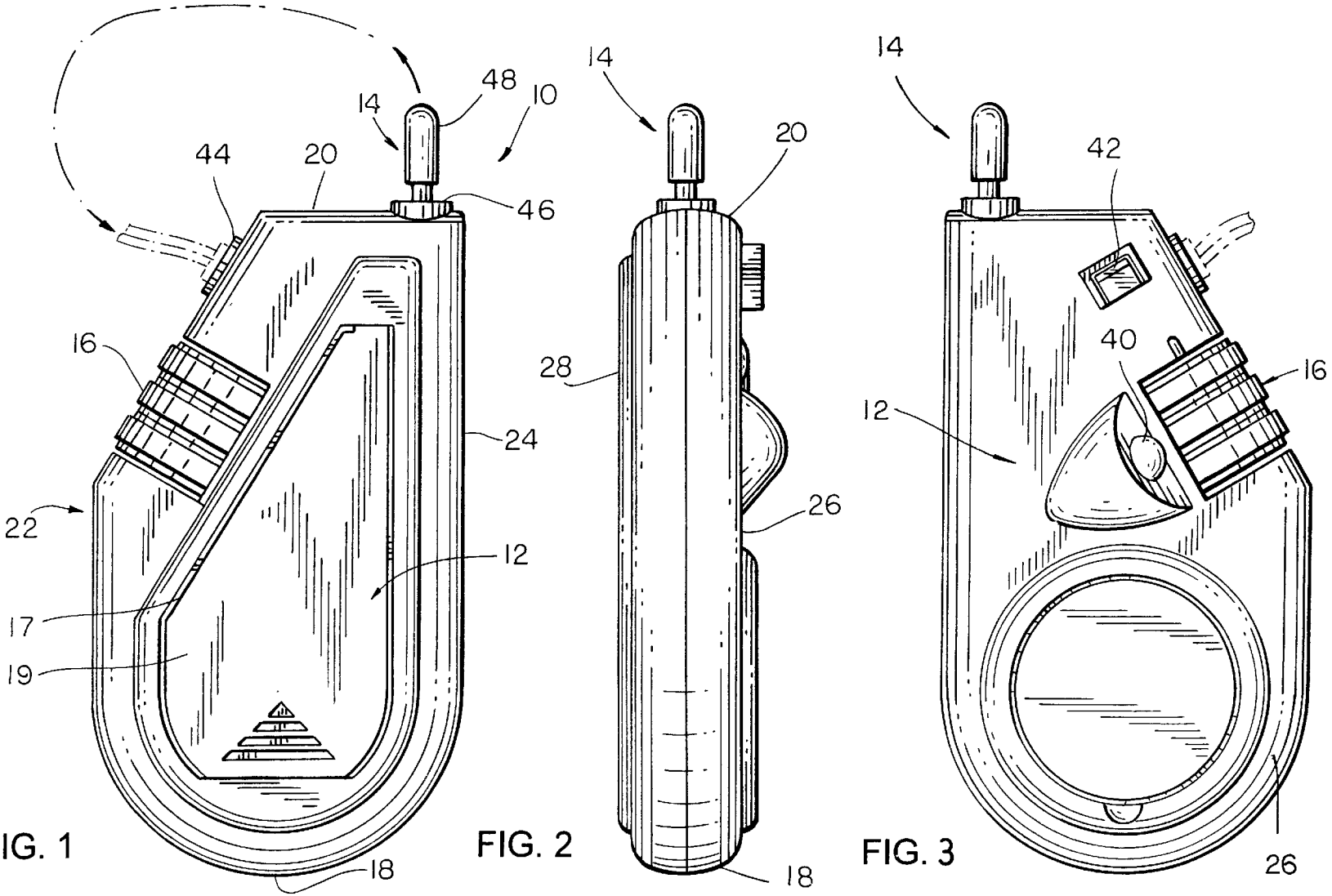
FIG. 1 is a rear perspective view of a portable cable lock according to an embodiment of the present invention.
FIG. 2 is a side perspective view of a portable cable lock according to an embodiment of the present invention.
FIG. 3 is a front perspective view of a portable cable lock according to an embodiment of the present invention.

In accordance with the invention, an embodiment of which is depicted in FIG. 1, a cable lock 10 comprises a housing 12. A locking member 14, including a head member 48, is retractably mounted within the housing 12, and a lock control mechanism 16 is mounted on the housing 12 for selectively locking and unlocking the locking member 14. That is, the locking member 14 can be withdrawn from the housing 12, wrapped around one or more objects to be secured and the head member 48 of the locking member 14 inserted into an opening 44 provided in the housing 12. Lock control 16 controls a locking mechanism that selectively retains the head member 48 and secures the distal end of the locking member 14 within the opening 44 of the housing 12.

The housing 12 is formed with a base 18 and a tip 20. First and second sidewalls 22 and 24, respectively, each extend from the base 18 to the tip 20. Front and back walls 26 and 28, respectively, each extend between the base 18, tip 20, and first and second sidewalls 22 and 24. The base 18 is wider than the tip 20, and the first and second sidewalls 22 and 24 are farther apart from each other near the base 18 than near the tip 20. The construction is such that when the housing 12 is grasped by a hand having any orientation relative to the housing, the lock control mechanism 16 is reachable for manipulation by at least one digit of the same hand.

An important feature of the invention as shown in FIG. 3, is the provision of a light 40 mounted on the housing 12 and particularly on the front wall 26 thereof for illuminating the lock control mechanism 16. A light control 42 is also arranged on the front wall 26 for selectively turning the light 40 ON and OFF.

The compact design which together with the novel housing construction makes this possible is facilitated by some design features described below.

Figure 4A:
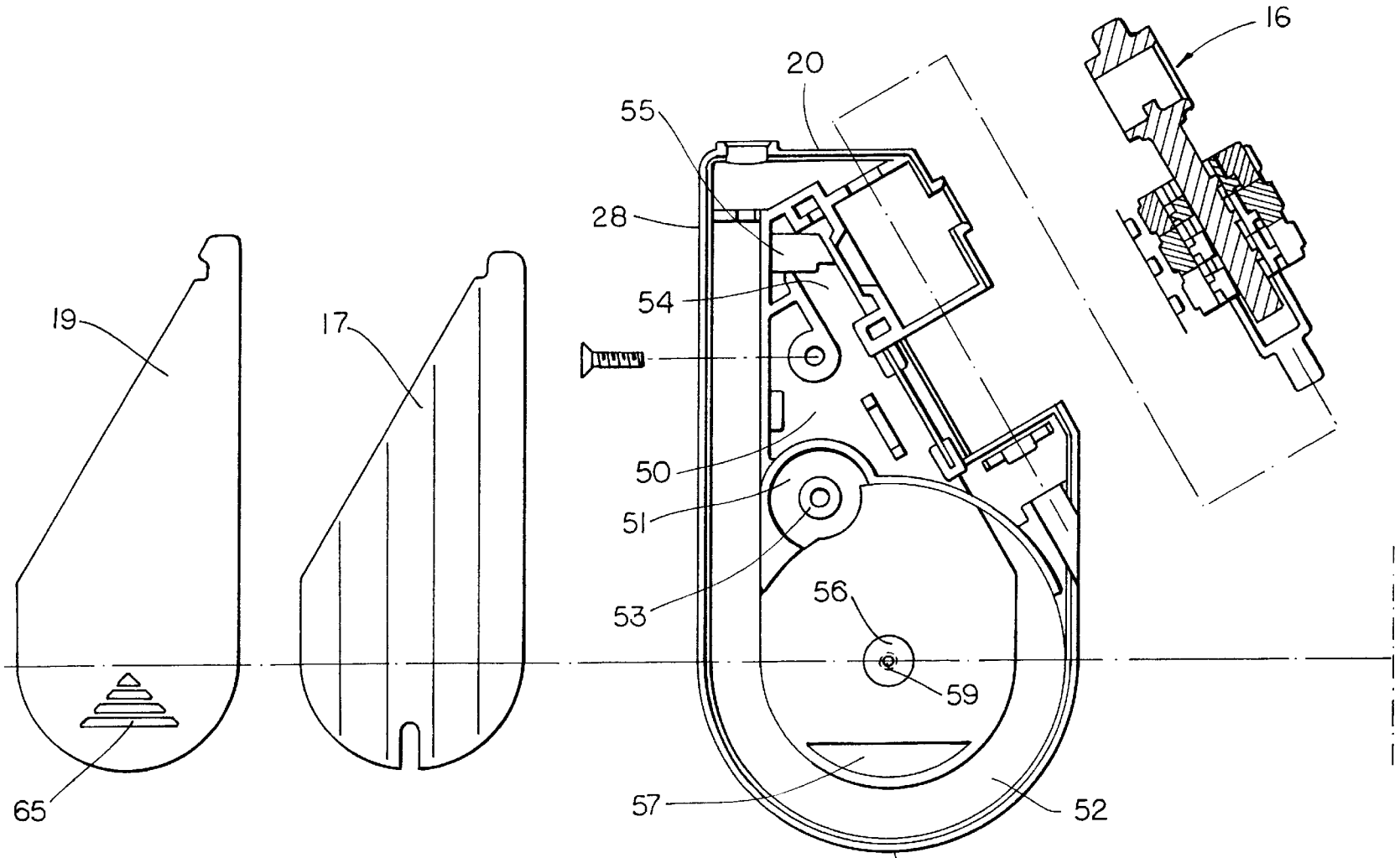
FIGS. 4A–4C are exploded views of a portable cable lock according to an embodiment of the present invention.
Figures 4B, 9:
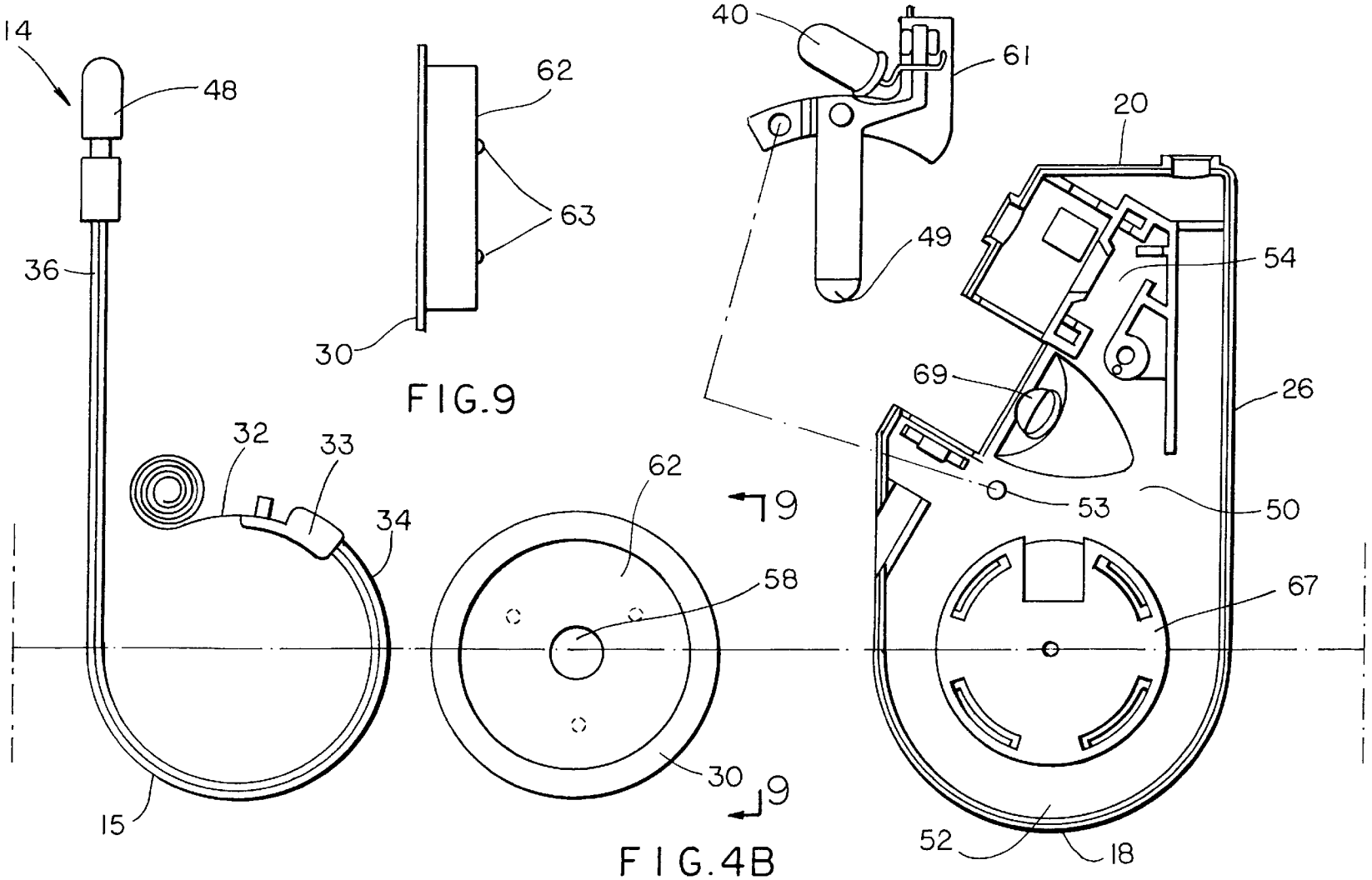
FIGS. 5–9 are views of a battery holder assembly according to an embodiment of the present invention.
Figure 4C:
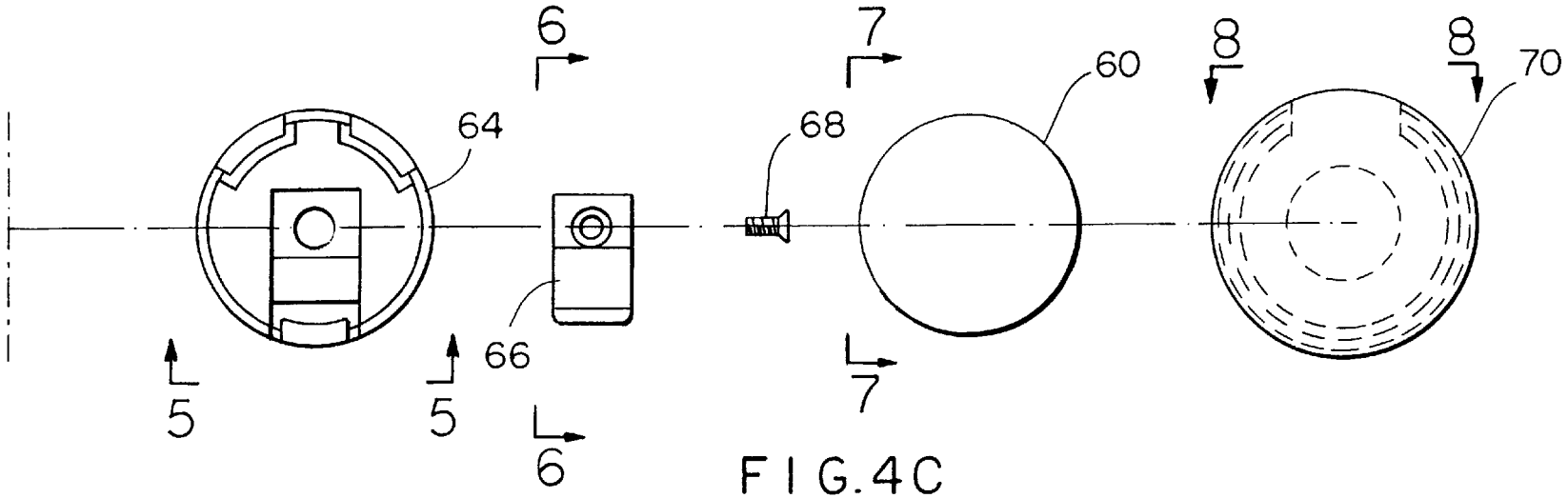
Figure 8:
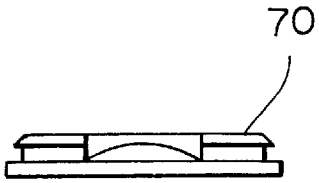
Figure 7:
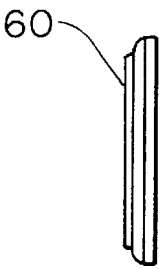
Figure 6:
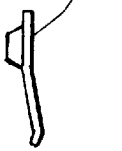
Figure 5:
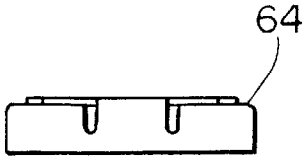

Each of the main elements making up the cable lock mechanism is shown in more detail in FIGS. 4A and 4B. A cover plate 19 rests on a vinyl member 17, both of which are mounted on the back wall housing 28, as shown more clearly in FIGS. 1 and 2. The cover plate 19 is made of Santoprene® or equivalent material and includes a raised surface portion 65 providing a gripping surface. Back wall 28 is formed of a molded plastic material and includes notches 55 and 57 (FIG. 4A) through which the ends of cover plate 19 and vinyl member 17 are inserted. A circular recessed portion 51 has a pin 53 extending therefrom. Lock control mechanism 16 rests within the front and back walls 26 and 28. Locking member 14 consists of a flexible cable 15 (FIG. 4B) having a distal end portion 36 including head member 48. Proximal end portion 34 of the flexible cable 15 includes a spring retaining member 33 having a spring 32 attached thereto. Cable 15 extends around the wheel or pulley 30. The wheel or pulley 30 has a hollow portion defining a compartment 62. A plurality of nubs 63 are provided on a rear surface of the wheel 30. Wheel 30 rotates on the spindle 56. Front wall 26 (FIG. 2) is also formed of a molded plastic material. Front wall 26 and back wall 28 include a first portion 52 (FIG. 4A) near the base 18 and a second portion 54 near the tip 20. A light assembly 61, including a light 40 (preferably a light emitting diode) and positive contact terminal 49 (FIG. 10), is mounted within the front wall 26 of the housing 12 on the pin 53, so that the light 40 rests within the lens cover 69.

The battery holder assembly is depicted in FIGS. 4C and 5–8. A screw 68 holds negative battery contact terminal 66 within battery holder 64. Battery holder 64 is itself hollow and directly accommodates the battery 60. Battery holder 64 is mounted within battery compartment 67 provided in the front wall 26. Battery compartment 67 sits within the compartment 62 of the wheel or pulley 30. Screw 68 is inserted through the negative contact 66, holder 64 and the battery compartment 67 and is secured to the retaining hole 59 in the back wall 28. A button 70 snaps onto the front wall 26 covering the battery compartment 67, thus protecting the battery compartment and the inside of the device against the elements and providing a neat appearance.

The housing 12 encloses a cavity 50 of which a first portion 52 is near the base 18 and a second portion 54 is near the tip 20. The first portion 52 is more commodious than the second portion 54 and accommodates both the wheel 30 and the battery 60 in a manner described in more detail below.

In accordance with a preferred embodiment of the invention, the pulley or wheel 30 has a compartment for accommodating battery compartment 67. Battery 60 preferably is accommodated in the separate battery holder 64 which is inserted into the battery compartment 67 provided in the front wall 26. In the alternative, the battery 60 can be provided directly in the battery compartment 67 or directly in the compartment 62.

Figure 10:
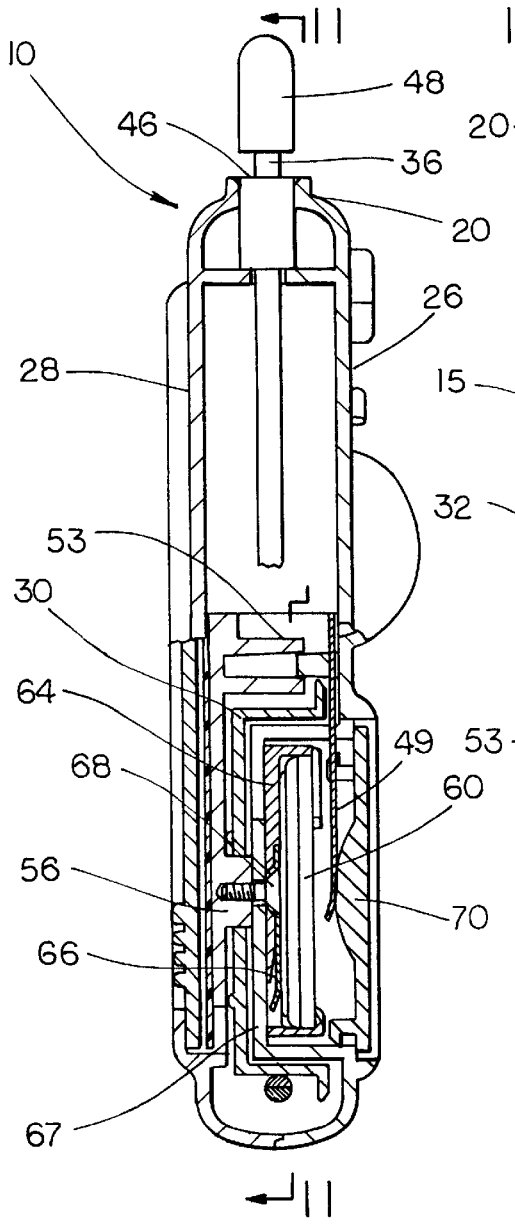
FIG. 10 is a sectional view of the cable lock according to an embodiment of the present invention, taken along the lines 10—10 as shown in FIG. 11.
Figure 11:
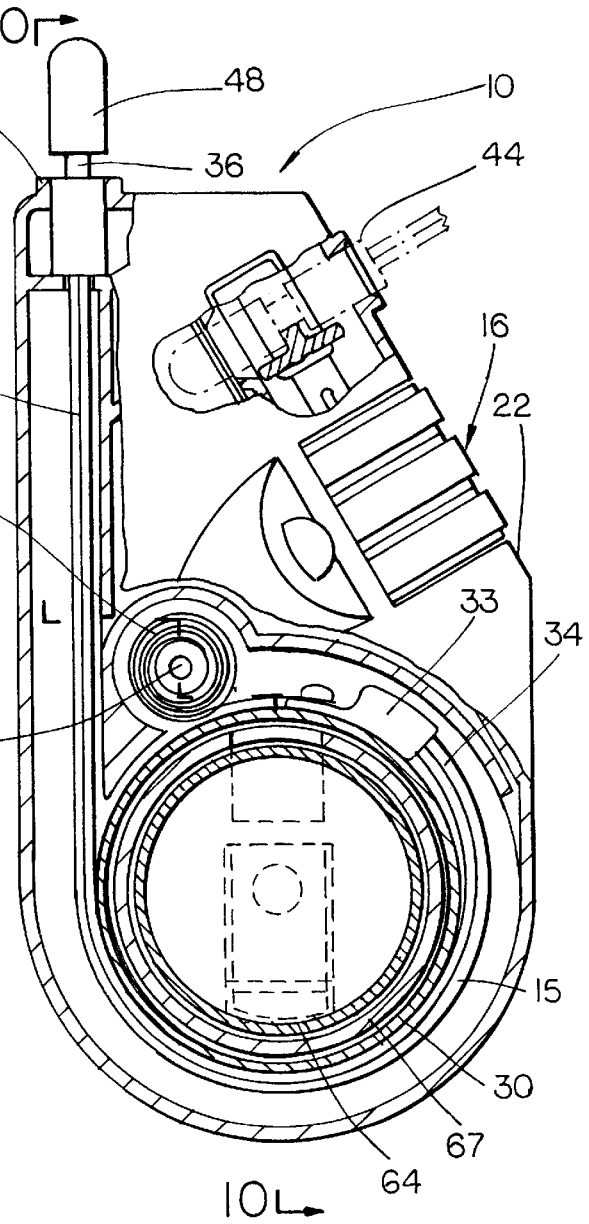
FIG. 11 is a sectional view of the cable lock assembly according to an embodiment of the present invention, taken along the lines 11—11 as shown in FIG. 10.

As shown more clearly in FIGS. 10 and 11, the locking member 14, consisting of flexible cable 15, has its proximal end portion 34 wound around the wheel 30 and the spring retaining member 33 is attached to the spring 32. Spring 32 rests in circular recessed portion 51 of the housing so that the pin 53 engages the spring 32 and maintains it in a predefined position. Spindle 56 extends into the orifice 58 provided in the center of the wheel 30, so that the wheel 30 is rotatable about the spindle 56. Screw 68 is inserted through the negative contact terminal 66, the battery holder 64, the hole in battery compartment 67 in front wall 26 and screwed into the spindle 56. Screw 68 thus holds the front wall 26 and the back wall 28 together, maintaining the wheel 30 rotatably positioned within the housing.

Distal end portion 36 of the cable 15 can be withdrawn from the housing 12, wrapped around or through one or more objects to be secured, and the head member 48 inserted into the housing 12 in locked relation thereto. The spring 32 exerts a force opposing withdrawing the distal end portion 36 from the housing 12 and tending to wind the cable 15 on the wheel 30. The spring 32 coils in a direction opposite that of the cable 15. Thus, if seen from a given vantage point, the cable 15 is coiled clockwise, the spring 32 is coiled counterclockwise. This makes it possible to place the coil of the cable in close juxtaposition to the coil of the spring, further minimizing the size of the lock. Positive battery contact terminal 49 extends into the battery compartment holding the battery 60. The positive and negative battery contact terminals 49 and 66, respectively, the light 40 and the light control 42 are electrically connected in a known manner, details of which will not be described in detail.

As described above, the housing 12 is formed with a first opening 46 through which the distal end portion 36 of the locking member 14 is withdrawn. The housing 12 also includes a second opening 44 through which the distal end portion 36 and, more particularly, a head member 48 attached thereto, can be inserted for locking engagement with the lock control mechanism 16. One of the first and second openings 44, 46 is formed in the tip 20, and the other of the first and second openings is formed in one of the first and second sidewalls 22, 24. The first opening 46 is formed preferably in the tip 20, and the second opening 44 is preferably formed in one of the first and second sidewalls.

Lock control mechanism 16 comprises means for setting a plurality of combinations of indicia of which one combination enables withdrawal of the head member 48 from the opening 44 in housing 12 and all others of the combinations prevent its withdrawal. Such lock mechanisms are well known in the art and will not be described in detail.

As described above, both the wheel 30 and the battery 60 are preferably circular, and the battery 60 and battery compartment 67 substantially fill the compartment 62 provided in the wheel 30. By accommodating the battery within the pulley, it becomes possible to provide adequate power for the light 40 without enlarging the housing. Moreover, the cable 15 can be coiled within the housing 12 without too tight a turn. This combination of features contributes to a design that is exceptionally compact, light in weight, and efficient.

Thus there is provided in accordance with the invention, a novel and highly effective cable lock that is exceptionally compact, light in weight, convenient to use, and especially adapted to the needs of travelers. Many modifications of the preferred embodiment of the invention disclosed herein will readily occur to those skilled in the art. The invention includes all such modifications as fall within the scope of the appended claims.

I claim:

1. An ergonomic, portable lock comprising:

a housing;

a locking member connected to said housing; and a lock control mounted on said housing for selectively locking and unlocking said locking member; wherein:

said housing is formed with a base and a tip, first and second sidewalls each extending from said base to said tip, and front and back walls each extending between said base, tip, and first and second sidewalls;

said base is wider than said tip, said first and second sidewalls are farther apart from each other near said base than near said tip, and said lock control is exposed through said front wall, said back wall, and one of said sidewalls;

whereby, when said housing is grasped by a hand having any orientation relative to said housing, said lock control is reachable for manipulation by at least one digit of the same hand;

further comprising a light mounted on said housing for illuminating said lock control and a light control mounted on said housing for selectively turning said light ON and OFF.

2. An ergonomic, portable lock comprising:

a housing;

a lock control mounted on said housing;

a light mounted on said housing for illuminating said lock control;

a wheel mounted within said housing and having a hollow portion concentric with said wheel and defining a compartment for accommodating a battery that is electrically connected to said light for powering said light; and a cable trained around said wheel and having a proximal end secured within said housing and a distal end adapted to be withdrawn from said housing, wrapped around one or more objects to be secured, and inserted into said housing in a state that is selectively locked or unlocked by said lock control.

3. A lock according to claim 2 wherein said battery compartment is circular.

4. A lock according to claim 3 further comprising a circular battery that substantially fills said battery compartment.

* * * * *